US008408547B2

(12) United States Patent
Crossman et al.

(10) Patent No.: US 8,408,547 B2
(45) Date of Patent: Apr. 2, 2013

(54) ADJUSTABLE GAMING REEL

(75) Inventors: Colin Crossman, Rhiwbina (GB); Adrian McIlraith, Colchester (GB); Anthony Jeffs, Crawley (GB); Kevin J. Schechtel, Algonquin, IL (US); Adrien Covington, Elgin, IL (US)

(73) Assignee: Suzo-Happ Group, Mt. Prospect, IL (US)

( * ) Notice: Subject to any disclaimer, the term of this patent is extended or adjusted under 35 U.S.C. 154(b) by 461 days.

(21) Appl. No.: 12/643,230

(22) Filed: Dec. 21, 2009

(65) Prior Publication Data

US 2011/0148037 A1 Jun. 23, 2011

(51) Int. Cl.
*G07F 17/34* (2006.01)

(52) U.S. Cl. ..... 273/143 R; 273/138.2; 463/20

(58) Field of Classification Search ..... 273/143 R, 273/138.2; 463/20

See application file for complete search history.

(56) References Cited

U.S. PATENT DOCUMENTS

| | | | | |
|---|---|---|---|---|
| 4,410,178 | A | 10/1983 | Partridge | |
| 4,711,451 | A | 12/1987 | Pajak | |
| 5,058,893 | A * | 10/1991 | Dickinson et al. | 273/143 R |
| 5,102,136 | A * | 4/1992 | Heidel et al. | 273/143 R |
| 5,388,829 | A | 2/1995 | Holmes | |
| 5,423,540 | A | 6/1995 | Taxon | |
| 5,688,172 | A | 11/1997 | Regidor | |
| 5,839,957 | A | 11/1998 | Schneider et al. | |
| 5,988,638 | A * | 11/1999 | Rodesch et al. | 273/143 R |
| 6,102,396 | A | 8/2000 | Liu | |
| 6,540,227 | B2 * | 4/2003 | Inoue | 273/143 R |
| 7,344,442 | B2 | 3/2008 | Inoue | |
| 2009/0098931 | A1 | 4/2009 | Shuster | |

FOREIGN PATENT DOCUMENTS

| | | |
|---|---|---|
| EP | 0603230 | 1/1996 |
| GB | 2182478 | 5/1987 |
| WO | WO 93/05484 | 3/1993 |

* cited by examiner

*Primary Examiner* — Benjamin Layno
(74) *Attorney, Agent, or Firm* — John S. Paniaguas; Katten Muchin Rosenman LLP

(57) ABSTRACT

A reel assembly for a gaming machine is disclosed. In accordance with an important aspect of the invention, alignment of the center lines of the symbols can be accomplished without the need to remove the reel assemblies from the gaming machine. The reel assembly includes a two piece motor mount assembly that carries a stepper motor and a lamp assembly. The two piece motor mount assembly includes a fixed mounting ring that is rigidly secured to a fixed reel assembly support and a rotatable mounting ring that is rotatable with respect to the fixed mounting ring. The rotatable mounting ring is interlocked with fixed mounting ring to enable rotation of the rotatable mounting ring, for example, by way of a tongue and groove arrangement with respect to the fixed mounting ring. The lamp assembly is also mounted to the rotatable mounting ring. An adjustment screw for locking the angular position of the fixed mounting ring with respect to the rotatable locking ring is accessible along a direction generally accessible while the reel assemblies are installed in the gaming machines. As such, alignment of the symbol center lines can be accomplished without removing the reel assemblies from the gaming machine.

11 Claims, 8 Drawing Sheets

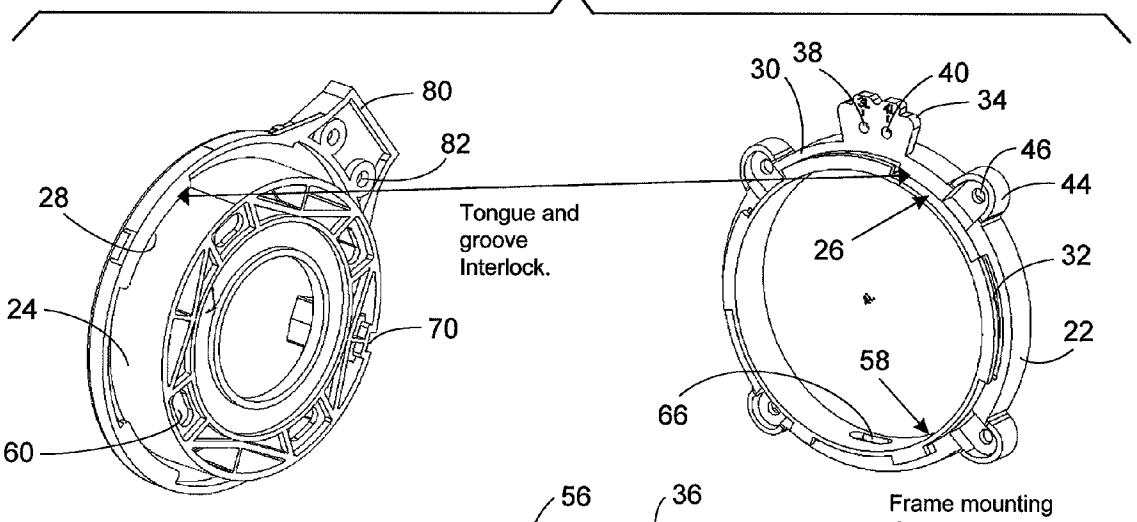
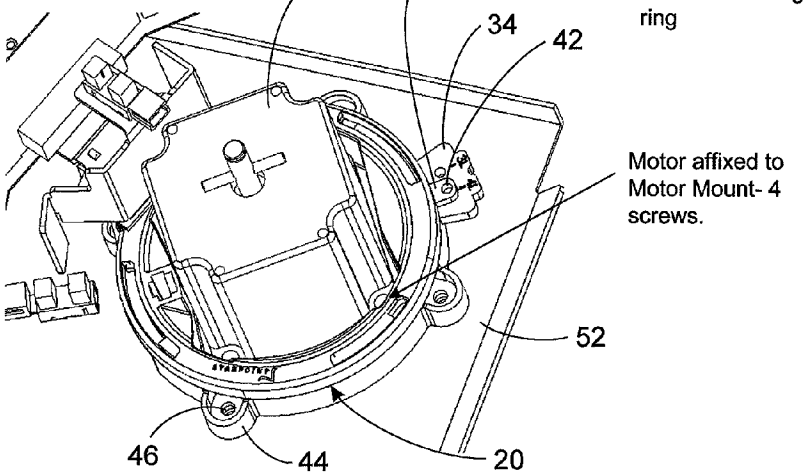
Fig. 6

ADJUSTABLE GAMING REEL

BACKGROUND OF THE INVENTION

1. Field of the Invention

The present invention relates to a reel assembly for a gaming machine and more particularly to a reel assembly for a gaming machine which includes a rotatable reel which carries a strip of symbols and a stepper motor and a lamp device carried by a two piece motor mount assembly configured to enable angular adjustment of the stepper motor with respect to a fixed reel support to facilitate centering of the symbols with the pay lines while the gaming reels remain within the gaming machine 2. Description of the Prior Art Gaming machines are well known in the art. Such gaming machines are known to include a plurality of reel assemblies. The reel assemblies include a rotatable reel which carries a plastic strip imprinted with symbols. The reel assemblies are rigidly supported in such gaming machines in a side by side relationship such that the axes of rotation of the rotatable reels are essentially horizontal and co-linear. Each rotatable reel is driven independently by a stepper motor, which, in turn, is under the control of stepper motor driver.

The stepper motor driver is a control system for controlling the operation of the stepper motor in response to an external signal. In the context of a gaming machine, the external signal is normally provided by a host game controller. In response to user input, such as a pull of the game lever or depressing a pushbutton to initiate the game, the host game controller generates a random number. As discussed in detail in U.S. Pat. No. 4,711,451, hereby incorporated by reference, each reel is divided up into a predetermined stop positions. These stop positions are stored in memory and normally coincide with the center positions of each of the symbols on the plastic strip carried by the reel. The random numbers generated by the random number generator are then associated with the addresses of the various stop positions for the reel assembly.

As mentioned above, each reel assembly is independently controlled. Thus, the host game controller generates a random number for each reel assembly. Customarily, gaming machines are provided with three (3) reel assemblies. Thus, the host game controller generates a random number for each of three (3) reel assemblies.

An exemplary reel assembly is illustrated in U.S. Pat. No. 5,388,829, hereby incorporated by reference. The gaming machine includes a window for each reel assembly on its front panel. The reel assemblies are mounted in the gaming machine so that one or more symbols on each reel are visible from the outside of the machine through the window. One or more co-linear pay lines are provided adjacent to the windows which indicate the combinations of symbols need to win. Up to four (4) pay lines per machine are known.

Each reel assembly includes a fixed lamp rigidly carried by a frame member. Each reel assembly also carries the stepper motor and the rotatable reel. The reel assemblies and the lamp assemblies are located so as illuminate the symbols behind the windows.

It is important that the symbols on the various side by side reels in the gaming machine be aligned relative to the pay lines. For example, for gaming machines with a single payline, the centerlines of the symbols for each of reels should be essentially co-linear and aligned with the pay line.

Many factors are known to affect the alignment. One factor is known as phase setting. Phase setting relates to the angular position of the symbol positions on power up. More particularly, in some known gaming machines, the reel is mechanically coupled to the stepper motor shaft by way of a cross pin, for example, as illustrated in detail in U.S. Pat. No. 4,410,178.

When the stepper motor driver is initially powered up, it does not know the angular position of the motor shaft or which winding to energize to cause the motor shaft to rotate. As such, the stepper motor is initialized by a procedure known as phase setting. In particular, one winding of the stepper motor is energized for a relatively short period of time, e.g. 1 second. This causes the motor to rotate to and lock in a zero phase position. Once locked in the zero phase position, an encoder counter internal to the stepper motor driver is reset to provide a fixed reference for applying power to each motor phase It is known that if a load, such as a reel, is applied to the stepper motor during power-up, the zero phase position will be offset slightly. Failure to correct the offset in the zero position can result in the symbols on the reels not properly lining up with the pay lines on the gaming machines and with the symbols on the other reels in the machine. Unfortunately, since gaming machines are configured so that the reel is directly coupled to the stepper motor on power up, the zero position will be offset. As such, manual adjustment is required in the field. In order to correct the offset in the phase setting in the field, the stepper motor housing is physically rotated with respect to the reel assembly frame to align the symbol centerlines with the various pay lines. The procedure for phase setting is described in detail in Standard Operating Procedure SOP-0205-01-N-DEV, Starpoint Electrics Ltd, Pages 1-36, January, 2004, hereby incorporated by reference. In as much as there are normally three (3) reel assemblies per gaming machine, phase setting of each of the reel assemblies in a gaming machine is cumbersome and time consuming.

In order to facilitate fine tuning of the adjustment of the symbol centerlines to the pay lines, various adjustable reel assemblies have been developed which enable the angular position of the stepper motor to be varied relative to a fixed support which carries the reel assembly. Such reel assemblies are disclosed in U.S. Pat. Nos. 5,423,540; 5,688,172; 6,102,396 and European Patent Application Publication No. EP 0 603 230 B1, herein incorporated by reference. Other known adjustable reel assemblies are illustrated in FIGS. 1 and 2. The adjustable reel assembly illustrated in FIG. 1 is manufactured by Starpoint Electrics Ltd. while the one illustrated in FIG. 2 is manufactured by Gamesman Ltd.

The various known reel assemblies as disclosed above all allow angular adjustment of the stepper motor with respect to the reel assembly's fixed support to enable the angular position of the stepper motor to be varied in order to align the symbol centerlines with the pay lines. In order to lock in an adjustment, the adjustment mechanisms all include an adjustment fastener. In order to adjust the angular position of the stepper motor, the adjustment fastener is first unloosened. After the adjustment fastener is unloosened, the stepper motor mount is rotated to the desired position. Once the stepper motor mount is rotated to the desired position, the adjustment screw is re-tightened to lock in the adjustment.

Unfortunately, as shown in FIGS. 1 and 2, the adjustment mechanisms in such reel assemblies are configured in such a manner which requires access to the adjustment screw by a fastener tool along a direction generally parallel to the axis of rotation of reel. Since the reels are disposed in a side by side relationship, the reel assemblies must be removed from the gaming machine in order to loosen the adjustment screw. The stepper motor mount is then rotated and the adjustment screw is re-tightened. After the adjustment screw is unloosened, the stepper motor mount can be rotated outside of the machine and retightened. Because the center line of the symbol must be aligned with the pay line, this method may take several iterations.

Alternatively, the reel assembly can be relocated into the gaming machine with the adjustment screw un-tightened. In the alternative method, the stepper motor mount is rotated to so that the centerline of the symbol on the reel is aligned with the pay line. The reel assembly is then removed to allow re-tightening of the adjustment screw. The reel assembly is then re-installed in the gaming machine. If the adjustment has slipped as a result of the removal and re-installation of the reel assembly, the process must be repeated.

Alignment of the symbol center lines with the pay lines with the various known reel assemblies is relatively cumbersome and time consuming. Thus, there is a need for a reel assembly that facilitates alignment of the symbol center lines with the pay lines.

SUMMARY OF THE INVENTION

The present invention relates to a reel assembly for a gaming machine. In accordance with an important aspect of the invention, alignment of the center lines of the symbols can be accomplished without the need to remove the reel assemblies from the gaming machine. The reel assembly includes a two piece motor mount assembly that carries a stepper motor and a lamp assembly. The two piece motor mount assembly includes a fixed mounting ring that is rigidly secured to a fixed reel assembly support and a rotatable mounting ring that is rotatable with respect to the fixed mounting ring. The rotatable mounting ring is interlocked with fixed mounting ring to enable rotation of the rotatable mounting ring, for example, by way of a tongue and groove arrangement with respect to the fixed mounting ring. The lamp assembly is also mounted to the rotatable mounting ring. An adjustment screw for locking the angular position of the fixed mounting ring with respect to the rotatable locking ring is accessible along a direction generally accessible while the reel assemblies are installed in the gaming machines. As such, alignment of the symbol center lines can be accomplished without removing the reel assemblies from the gaming machine.

DESCRIPTION OF THE DRAWING

These and other advantages of the present invention will be readily understood with reference to the following specification and attached drawing wherein:

FIG. 5 illustrates a two piece motor mount for use with the present invention.

FIG. 6 illustrates a stepper motor assembled to the two piece motor mount illustrated in FIG. 5, which, in turn, is mounted to a fixed reel support which forms part of the adjustable reel assembly in accordance with the present invention.

DETAILED DESCRIPTION

Figure 1:
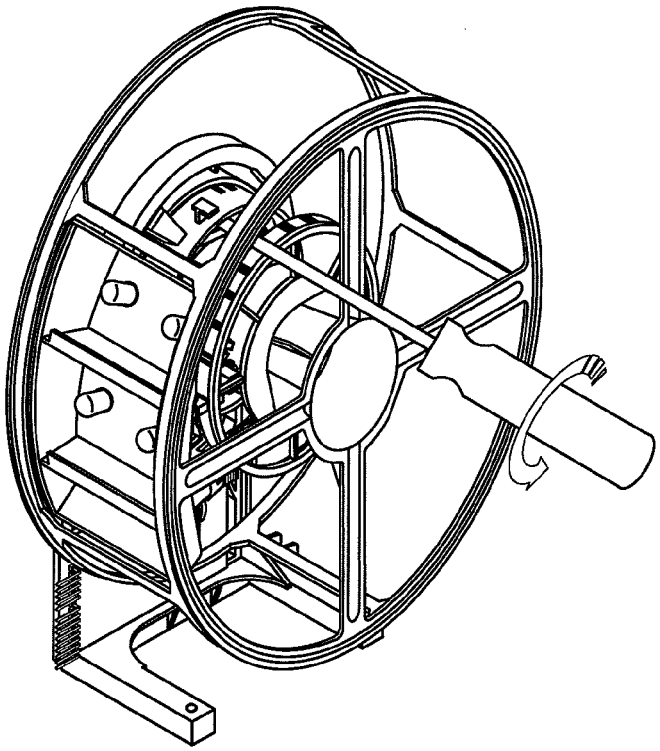
Fig. 1 (Prior Art)
FIG. 1 is an isometric drawing of a known adjustable reel assembly for a gaming machine as manufactured by Starpoint Electrics Ltd.
Figure 2:
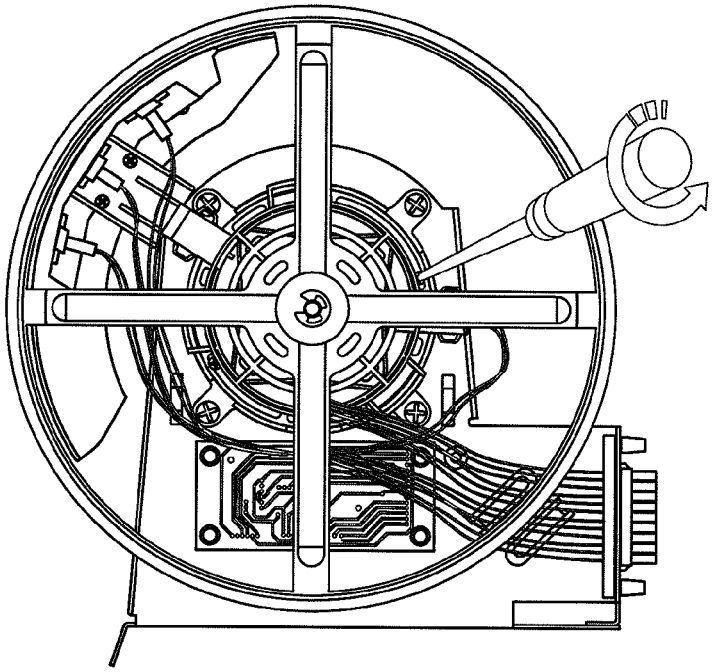
Fig. 2 (Prior Art)
FIG. 2 is an isometric drawing of a known adjustable reel assembly for a gaming machine as manufactured by Gamesman Ltd.

The present invention relates to a reel assembly for a gaming machine. In accordance with an important aspect of the invention, alignment of the center lines of the symbols can be accomplished without the need to remove the reel assemblies from the gaming machine. The reel assembly includes a two piece motor mount assembly that carries a stepper motor and a lamp assembly. The two piece motor mount assembly includes a fixed mounting ring that is rigidly secured to a fixed reel assembly support and a rotatable mounting ring that is rotatable with respect to the fixed mounting ring. The rotatable mounting ring is interlocked with fixed mounting ring to enable rotation of the rotatable mounting ring, for example, by way of a tongue and groove arrangement with respect to the fixed mounting ring. The lamp assembly is also mounted to the rotatable mounting ring. An adjustment screw for locking the angular position of the fixed mounting ring with respect to the rotatable locking ring is accessible along a direction generally accessible while the reel assemblies are installed in the gaming machines. As such, alignment of the symbol center lines can be accomplished without removing the reel assemblies from the gaming machine.

Referring first to FIGS. 5 and 6, the reel assembly in accordance with the present invention includes a two piece motor mount assembly, generally identified with the reference numeral 20. The motor mount includes a fixed mounting ring 22 and a rotatable mounting ring 24. The fixed mounting ring 22 and the rotatable mounting ring 24 are interlocked together to enable rotation of the rotatable mounting ring 24 with respect to the fixed mounting ring 22.

As shown in FIG. 5, an exemplary tongue and groove interlocking arrangement is illustrated between the fixed mounting ring 22 and the rotatable mounting ring 24. However. Other interlocking arrangements are possible and contemplated to be within the scope of the invention that allow rotation between the fixed mounting ring 22 and the rotatable mounting ring 24 and can be locked and unlocked in place while the reel assemblies are installed in the gaming machine.

Referring to FIG. 5, the fixed mounting ring 22 is formed as a ring like device which includes a plurality of radially disposed arcuate grooves, generally identified with the reference numeral 26. The arcuate length of arcuate grooves 26 is selected to be longer than the arcuate length of corresponding tongues, generally identified with the reference numeral 28, formed on the rotatable ring 24. The tongues 28 are radially disposed around the rotatable ring 24 to correspond to the radial positions of the arcuate grooves 26, formed on the fixed mounting ring 22. As such, when the fixed mounting ring 22 is assembled to the rotatable mounting ring 24, the tongues 28 on the rotatable mounting ring 24 are received in the grooves 26 on the fixed mounting ring 22. The difference in arcuate length between the tongues 28 on the rotatable mounting ring 24 and the grooves 26 on the fixed mounting ring 22 allows rotation of the rotatable mounting ring 24 with respect to the fixed mounting ring 22.

The grooves 26 on the fixed mounting ring 22 are formed between spaced apart tongues, generally identified with the reference numerals 30 and 32, on the fixed mounting ring 22. The tongues 30 and 32 on the fixed mounting ring 22 act as stops and contact the tongues 28 on the rotatable mounting ring 24 to limit rotation of the rotatable ring 24 in both a clockwise and counter-clockwise direction. As will be discussed in more detail below, rotation of the rotatable mounting ring 24 causes rotation of the stepper motor housing in order to allow fine adjustment of the symbol center lines with the pay lines.

Figure 8:
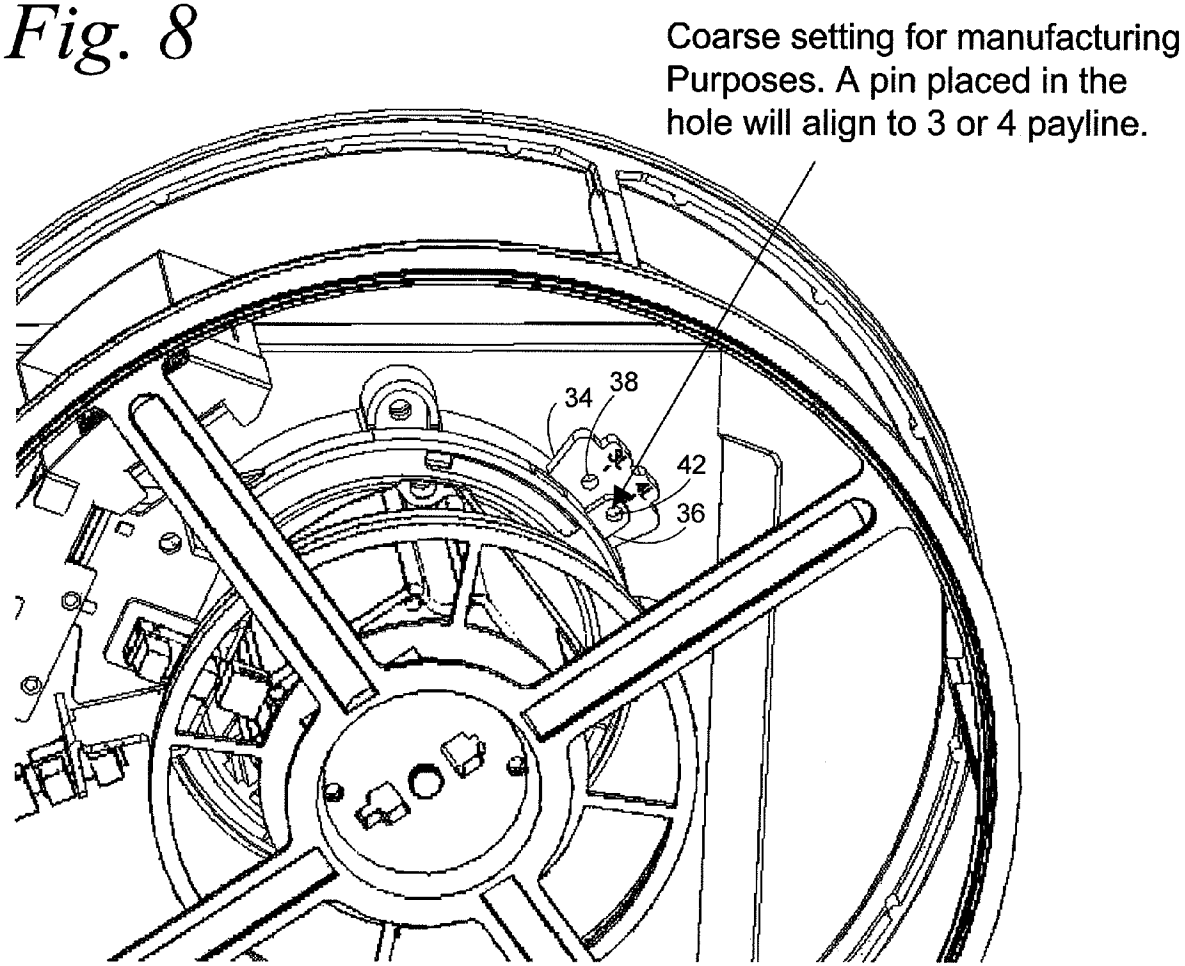
FIG. 8 is a partial isometric view of the adjustable reel assembly in accordance with the present invention illustrating an optional course adjustment feature for gaming machines with three (3) and four (4) pay lines.

The fixed mounting ring 22 may be provided with an optional tab 34 extending radially outwardly from the periphery of the fixed mounting ring 22 for the purpose of providing a course setting for gaming machines with three (3) or four (4) pay lines. The tab 34 co-operates with an optional extending tab 36 on the rotatable mounting ring 24. The tab 34 includes a pair of through holes 38 and 40 while the tab 36 includes a single through hole 42 that is configured to be aligned with the through holes 38 and 40 on the tab 34. As best shown in FIG. 8, a pin (not shown) can be disposed in the through hole 42 and alternatively one or the other of the through holes 38 and 40 to enable the reel assemblies to be shipped from the factory with course settings for gaming machines with three or 4 pay lines.

Figure 7:
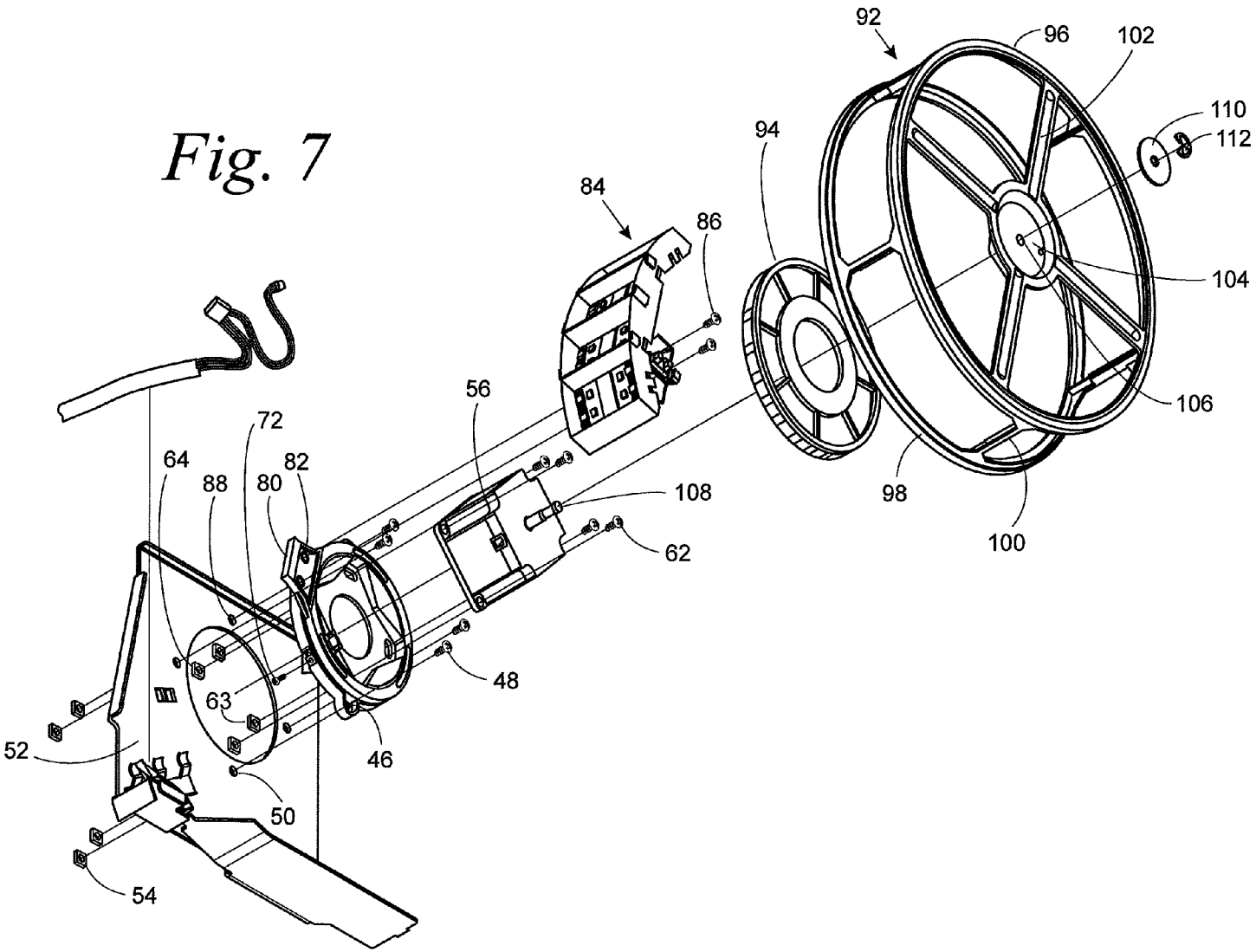
FIG. 7 is an exploded isometric view of the adjustable reel in accordance with the present invention.

The fixed mounting ring 22 also includes a plurality of radially extending mounting ears, generally identified with the reference numeral 44. Each mounting ear 44 includes a through hole 46 for receiving a fastener 48 (FIG. 7). The through holes 46 are aligned with through holes 50 formed in a reel assembly support plate 52. The fasteners 48 and corresponding nuts 54 enable the fixed support 24 to be rigidly secured to the reel assembly support plate 52.

Returning to FIG. 5, the rotatable mounting ring 24 is illustrated. The rotatable mounting ring 24 acts as a motor mount for a stepper motor 56. The stepper motor 56 is rigidly secured to the rotatable mounting ring 24. More specifically, the rotatable mounting ring is formed as a basket type device. The rotatable ring is configured such that the basket fits within a central aperture 58 of the fixed mounting ring 22. The axial dimensions of the basket are selected so that the tongues 28 are received in the respective grooves 26 of the fixed mounting ring 22. The rotatable mounting ring 24 is provided with a plurality of slots, generally identified with the reference numeral 60. These slots are for receiving fasteners, generally identified with the reference numeral 62 (FIG. 7) which enable the stepper motor 56 to be rigidly secured to the rotatable mounting ring 24 by way of cooperating nuts 64. Once the stepper motor 56 is secured to the rotatable mounting plate 24, rotation of the rotatable mounting plate 24 causes rotation of the stepper motor housing.

Once the angular adjustment of the rotatable mounting ring 24 is made with respect to the fixed mounting ring, it is necessary to prevent further rotation of the rotatable mounting ring 24 with respect to the fixed mounting ring 22. Various locking mechanisms can be used for this purpose, It is important that the locking mechanism be accessible while the reel assemblies are installed in a gaming machine.

Figure 3:
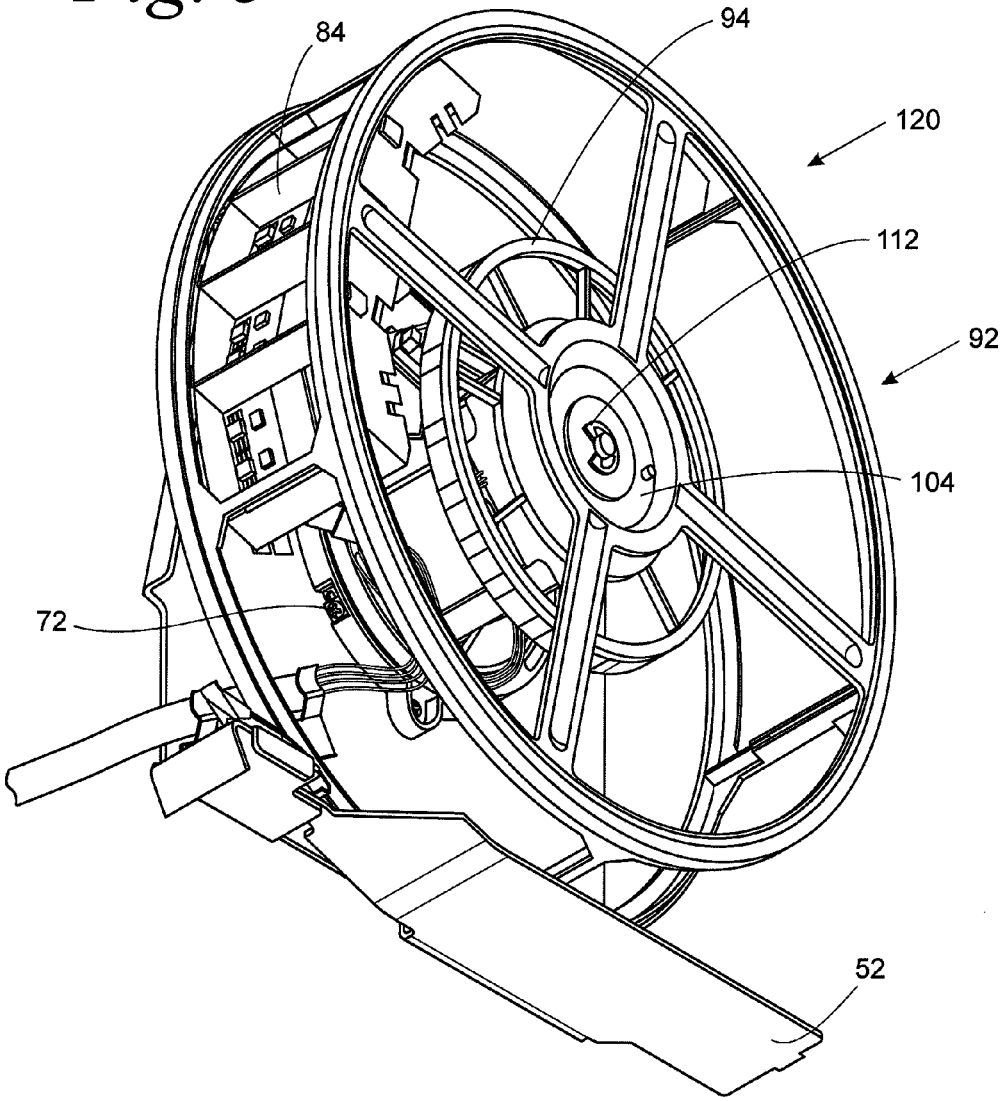
FIG. 3 is an isometric view of an adjustable reel assembly in accordance with the present invention.
Figure 10:
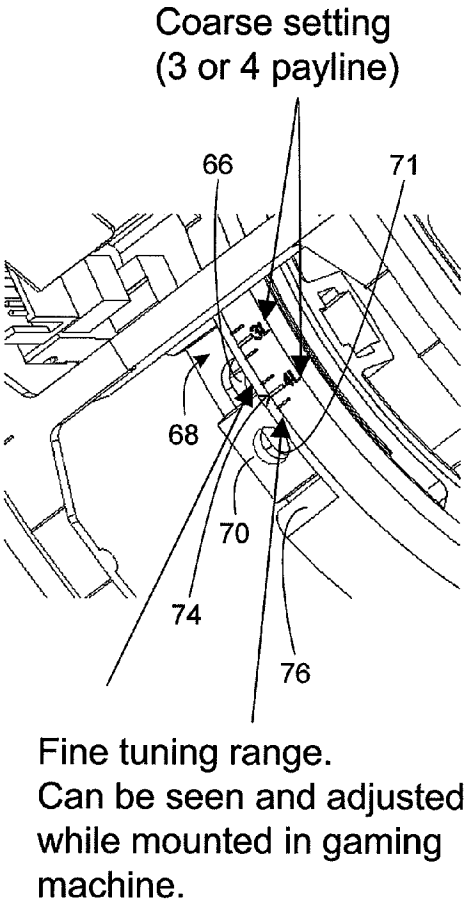
FIG. 10 is a partial isometric view of the adjustable reel assembly in accordance with the present invention illustrating an optional course adjustment feature.
Figure 9:
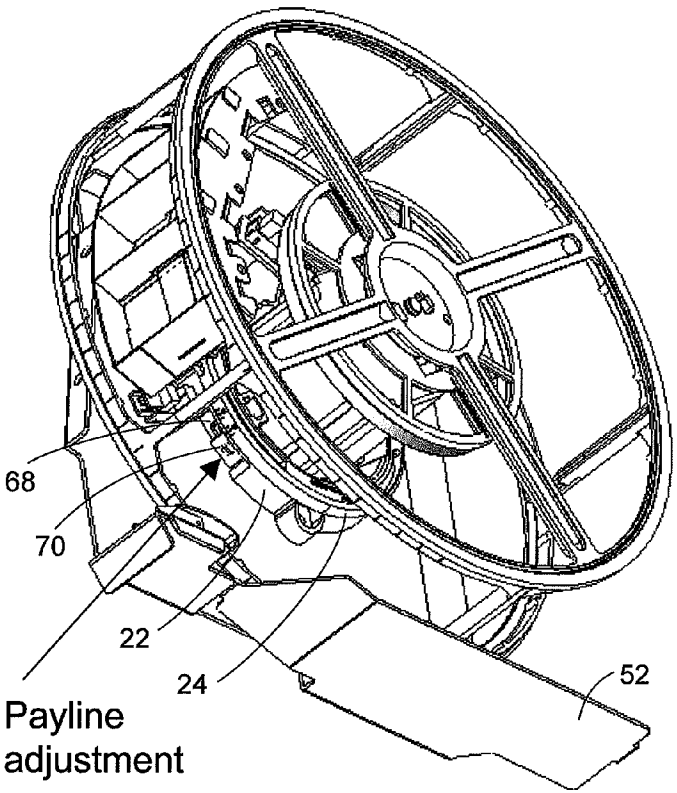
FIG. 9 is an isometric view of the adjustable reel assembly in accordance with the present invention illustrating the location of the adjustment screw.

An exemplary locking mechanism is described and illustrated. More specifically, as best shown in FIG. 5, a slot 66 is formed in the fixed mounting ring 22. The slot 66 is disposed between adjacent tongues 30 on the fixed mounting ring 22. As best shown in FIG. 9, the rotatable mounting ring 24 includes an axial notch 68. The axial notch 68 on the rotatable mounting ring 24 is aligned with the slot 66 in the fixed mounting ring 22. As best shown in FIGS. 9 and 10 a rectangular locking element 70, formed as a rectangular block, is disposed in the notch 68. The rectangular locking element 70 includes a through hole 71 that is configured to be aligned with the slot 66 in the fixed mounting ring 22. A fastener 72 (FIGS. 3 and 6) is received in the through hole 71 in the rectangular locking element 70 and the slot 66 in the fixed mounting ring 22. A nut (not shown) is used to secure the washer 70 with respect to the slot 66. In order to prevent rotation of the nut during tightening and un-tightening, the nut may be a square nut, captured within the slot 66. The rectangular locking element 70 is configured so that when it is tightened down it exerts compression forces along a direction generally parallel to the axis of rotation against the rotatable mounting ring 24. In as much is the rectangular locking element 70 is secured to the fixed mounting ring 22, rotation of the rotatable mounting ring 24 is prevented when the rectangular locking element 70 is securely fastened in place. When the fastener 72 (FIG. 7) is unloosened, the rectangular locking element 70 is free to move with respect with respect to the fixed mounting ring 22 and the compression forces applied to the rotatable ring 24 are decreased to enable the rotatable mounting ring 24 to be rotated with respect to the fixed mounting ring 22.

The rectangular locking element 70 may optionally include a pointer 74 as best shown in FIG. 10. The pointer 74 may be used with the graduations formed on the rotatable mounting ring 24 to indicate course and fine settings for three (3) and four (4) pay lines. As shown, when the reel assembly is adjusted for four (4) pay lines, the rectangular locking element seats against a shoulder 76 formed in the fixed mounting ring 22. As the rotatable mounting ring 24 is rotated in a counter-clockwise direction, the reel assembly is adjusted toward a three (3) pay line configuration. The pointer 74 and the calibration hash marks on the rotatable mounting ring 24 are disposed near the adjustment screw 72. Thus, in addition to being able to adjust the angular position of the stepper motor housing while the reel assemblies are installed in a gaming machine, the pay line setting can be seen as well.

Referring back to FIG. 5, the rotatable mounting ring 24 includes an extending tab 80 which includes a pair of through holes, generally identified with the reference numeral 82. The tab 80 allows a lamp assembly 84 to be secured to the rotatable mounting ring 24 by way of a plurality of fasteners 86 (FIG. 7) and nuts 88. As such, the lamp assembly 84 will rotate as the rotatable mounting ring 24 is rotated.

Figure 11:
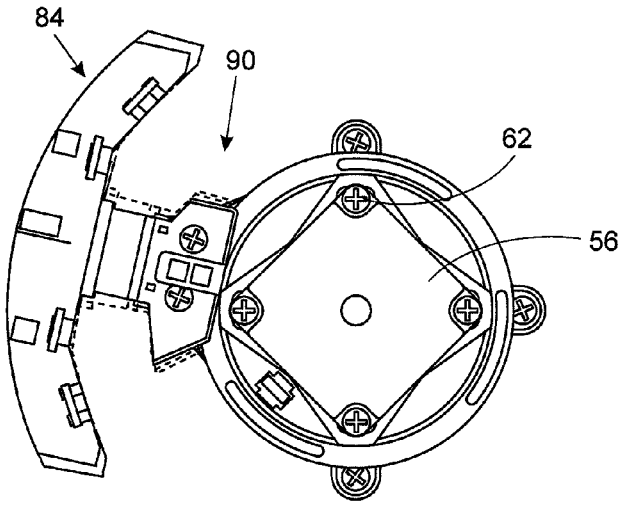
FIG. 11 is a side elevation view of illustrating the stepper motor and the lamp assembly assembled to the motor mount assembly in accordance with the present invention.

Referring to FIG. 11, the stepper motor 56 is secured to the rotatable mounting ring 24 by way of the fasteners 62 and nuts 63 (FIG. 7). The lamp assembly 84 (FIG. 11) is also secured to the rotatable mounting ring 24 by way of the fasteners 86 and nuts 88 (FIG. 7) forming an assembly 90, as generally shown in FIG. 11. The assembly 90 is secured to the reel support plate 52 (FIG. 7) by way of the fasteners 48 (FIG. 7) and nuts 50.

Figure 12:
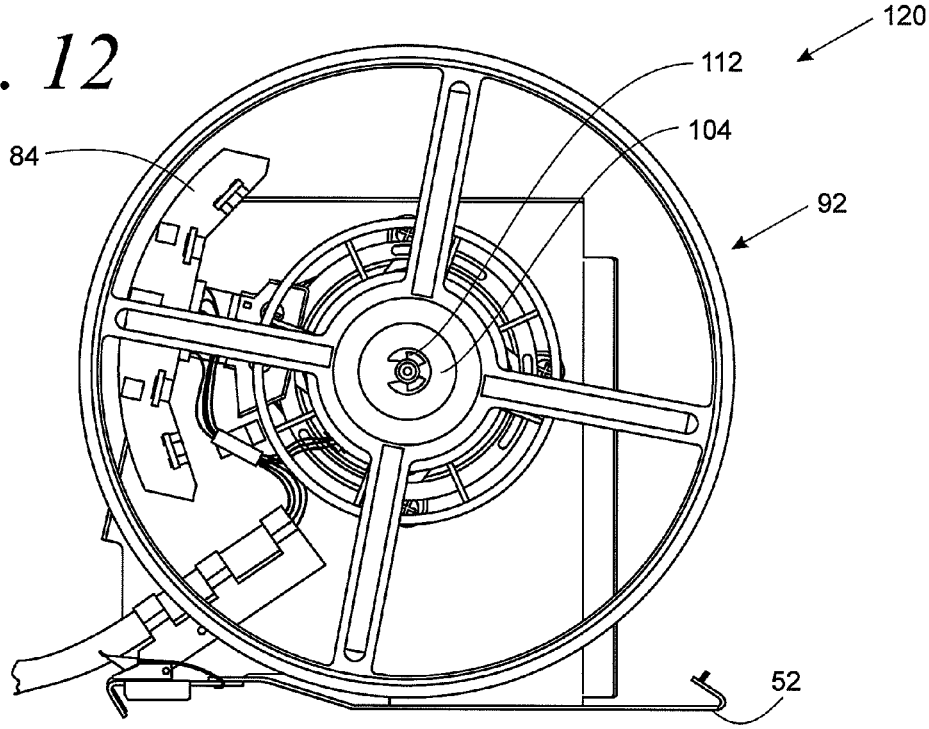
FIG. 12 is a side elevation view of the adjustable gaming reel in accordance with the present invention.

Referring back to FIG. 7, a reel 92 and an encoder wheel 94 is assembled to the assembly 90. As shown, the reel 92 is formed with a pair of spaced apart rings 96 and 98 joined together by a number of cross-over members, generally identified with the reference numeral 100. Each ring 96 and 98 includes a number of spokes, generally identified with the reference numeral 102. The spokes 102 are connected between in the inner diameter of the rings 96 and 98 and a hub 104. The hub 104 includes a central aperture 106 for receiving a shaft 108 from the stepper motor 56. The hub 104 is formed with an inwardly facing spindle 110 for carrying the encoder wheel 94. The motor shaft 108 is secured to the hub 104 by way of a washer 110 and a c-clip 122 to form the reel assembly 120 illustrated in FIGS. 3 and 12. The reel assembly 120 also includes an optical sensor (not shown) for sensing the angular position of the reel by way of the encoder wheel 94 mounted to the reel support plate 52. Such encoder wheels and optical sensors are well known in the art.

Figure 4:
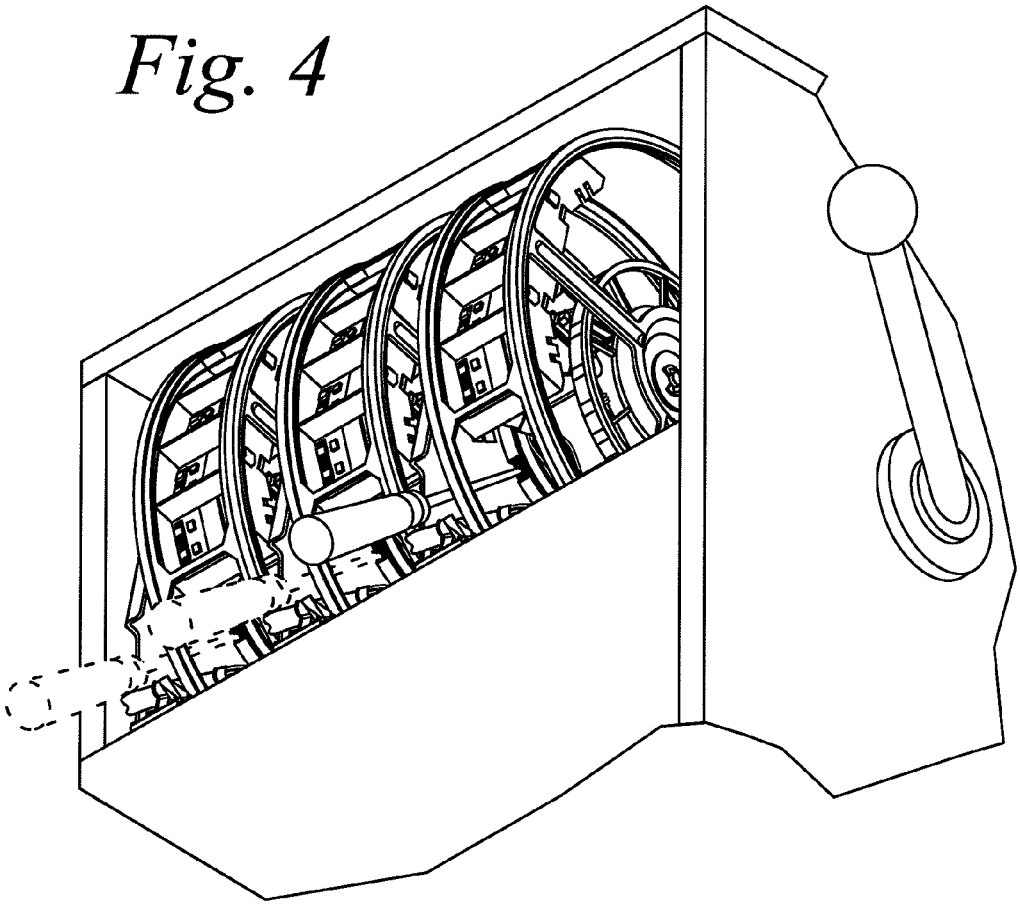
FIG. 4 is a partial isometric view of an exemplary gaming machine with a rear access door removed, which illustrates access to the adjustment screws on the reel assembly while the reel assemblies are installed in a gaming machine.

The rotatable mounting rings 24 of each of the reel assemblies 120 can be accessed from the rear of the gaming machines. As generally illustrated in FIG. 4. Once the fastener 92 (FIG. 7) securing the rectangular locking element 70 (FIG. 10) is loosened, the rotatable mounting ring 24 can easily be rotated, for example, by grabbing a lamp assembly 84 and rotating it. This action will cause the rotatable mounting ring 24 to rotate and thus the stepper motor housing to rotate with respect to the reel support plate 52. The rotatable mounting ring is rotated until a center line of a symbol is aligned with the pay line on the window in the front of the reel assembly. Once the symbol center line is aligned with the pay line, the rotatable mounting ring 24 is secured in the manner as discussed above. The process is repeated for all of the reel assemblies 120 in the gaming machine until the centerlines of the symbols on all of the reel assemblies are co-linear and aligned with the pay lines.

Obviously, many modifications and variations of the present invention are possible in light of the above teachings. Thus, it is to be understood that, within the scope of the appended claims, the invention may be practiced otherwise than as specifically described above.

We claim:

1. A reel assembly for a gaming machine comprising:

a motor mount comprising a fixed mounting ring and a rotatable mounting ring formed to be connected together in an interlocking arrangement, said rotatable mounting ring being rotatable with respect to said fixed mounting ring to enable the angular position of said rotatable mounting ring to be rotated with respect to said fixed mounting ring;

a stepper motor having a shaft, said stepper motor rigidly secured to the rotatable mounting ring, said shaft defining an axis of rotation;

a lamp assembly rigidly secured to the rotatable mounting ring;

a reel mechanically coupled to said motor shaft;

an encoder wheel mechanically coupled to said reel;

an optical sensor for sensing the angular position of said reel; and a locking mechanism which enables the angular position of said rotatable mounting ring relative to said fixed mounting ring to be locked in a first mode of operation and allows said rotatable mounting ring to be rotated relative to said fixed mounting ring in a second mode of operation, wherein said locking mechanism is formed so as to be accessible while the reel assemblies are installed in a gaming machine to enable the angular position of the stepper motor to be adjusted while the reel assemblies are installed in a gaming machine; and a fixed reel support for carrying said motor mount, said stepper motor, said reel, said encoder wheel, said optical sensor and said locking mechanism.

2. The reel assembly as recited in claim 1, wherein said interlocking arrangement includes a tongue and groove arrangement for interlocking said fixed mounting ring and said rotatable mounting ring together in an axial direction.

3. The reel assembly as recited in claim 1, wherein said locking assembly exerts compression forces between said rotatable mounting ring and said fixed mounting ring in said first mode of operation to prevent angular movement of said rotatable mounting ring and said fixed mounting ring and enables rotation of said rotatable mounting ring and said fixed mounting ring in said second mode of operation.

4. The reel assembly as recited in claim 3, wherein said locking assembly includes a screw and nut for securing and unsecuring said rotatable mounting ring relative to said fixed mounting ring.

5. The reel assembly as recited in claim 4, wherein said screw is accessible after the reel assemblies are installed in a gaming machine.

6. The reel assembly as recited in claim 1, further including a coarse adjustment mechanism for providing a coarse adjustment of the rotatable mounting ring with respect to fixed mounting ring.

7. The reel assembly as recited in claim 6, wherein said coarse adjustment mechanism is used to provide one or more fixed angular positions of said rotatable mounting ring relative to said fixed mounting ring.

8. The reel assembly as recited in claim 6, wherein said coarse adjustment mechanism is configured to lock one of said one or more fixed angular positions of said rotatable mounting ring relative to said fixed mounting ring in place.

9. The reel assembly as recited in claim 1, further including a pointer movable with said rotatable mounting ring and cooperating hash marks on said fixed mounting ring to indicate course positions of said rotatable mounting ring with respect to fixed mounting ring for reels with different numbers of pay lines.

10. The reel assembly as recited in claim 1, wherein the fixed mounting ring includes a tab extending radially outwardly therefrom and said rotatable mounting ring includes another radially extending tab that cooperates with said tab extending radially outwardly from said fixed mounting ring, each of said tabs including at least one through hole, said tabs disposed at predetermined radial positions of said rotatable mounting ring with respect to said fixed mounting ring, said through holes configured to receive a pin to secure the radial position of said rotatable mounting ring with respect to said fixed mounting ring at one of said predetermined positions.

11. A method of adjusting the angular position of a reel in a gaming machine relative to one or more pay lines on said gaming machine in a gaming machine in which said reel is mounted to a motor mount comprising a fixed mounting ring and a rotatable mounting ring and a locking mechanism for securing the angular position of said rotatable ring with respect to said fixed ring in a first mode of operation and enabling said rotatable mounting ring to be rotated relative to said fixed mounting ring in a second mode of operation, the method comprising the steps of:

(a) placing said locking mechanism in said second mode of operation while said reel is within said gaming machine;

(b) rotating said reel to the desired position; and (c) placing said locking mechanism in said first mode of operation after said reel is in said desired position.

* * * * *